US012546568B2

(12) United States Patent
Mansfield

(10) Patent No.: US 12,546,568 B2
(45) Date of Patent: Feb. 10, 2026

(54) FIREARM TRAINING APPARATUS AND RELATED METHODS OF USE

(71) Applicant: Michael R. Mansfield, Sarasota, FL (US)

(72) Inventor: Michael R. Mansfield, Sarasota, FL (US)

( * ) Notice: Subject to any disclaimer, the term of this patent is extended or adjusted under 35 U.S.C. 154(b) by 850 days.

(21) Appl. No.: 17/716,815

(22) Filed: Apr. 8, 2022

(65) Prior Publication Data

US 2023/0324146 A1 Oct. 12, 2023

(51) Int. Cl.
*F41G 3/26* (2006.01)
*A63B 21/00* (2006.01)

(52) U.S. Cl.
CPC ..... *F41G 3/26* (2013.01); *A63B 21/4023* (2015.10)

(58) Field of Classification Search
CPC ..... F41G 3/26; F41G 3/30; A63B 21/4023; A63B 21/0442; A63B 21/0557; A63B 21/16; F41A 33/00
See application file for complete search history.

(56) References Cited

U.S. PATENT DOCUMENTS 2,078,010 A 4/1937 Max
2,102,964 A 12/1937 Mossberg
2,480,662 A 8/1949 Mckinzie
2,640,395 A * 6/1953 Clark ..... F41A 27/06 89/37.17
2,642,689 A 6/1953 Cline
2,763,082 A 9/1956 Sprague
3,061,965 A 11/1962 Lewis
4,506,466 A * 3/1985 Hall ..... F41A 23/00 108/115
4,823,491 A 4/1989 Llames
5,599,187 A * 2/1997 Mesiano ..... F41G 3/26 124/56
5,692,654 A 12/1997 Bell
5,915,939 A 6/1999 French
6,325,258 B1 12/2001 Verdugo et al.
6,536,153 B2 3/2003 Lindsey
D495,870 S 9/2004 Verdugo
D508,726 S 8/2005 Storch
7,082,709 B2 8/2006 Lindsey
D683,807 S 6/2013 Elkaim
(Continued)

OTHER PUBLICATIONS

Alex Mann, "SA shooting range safety measure delay blamed on Government", Jan. 14, 2016, ABC News, Australia (Year: 2016).*
Alex Mann NPL (Year: 2016).*

*Primary Examiner* — Peter S Vasat
*Assistant Examiner* — Selwa A Alsomairy
(74) *Attorney, Agent, or Firm* — Cardle Patent Law, Chtd.

(57) ABSTRACT

A method of firearm training includes the step of attaching a cord to a firearm and the step of attaching the cord to a frame. The frame may include two vertically oriented members oriented in parallel spaced relation. Several attachment points are disposed upon the vertical members, and the cord may be engaged with an attachment point selected from the several attachment points. The method of firearm training includes the step of tensioning the cord while aiming the firearm thereby applying a force to the firearm. In various aspects, the cord may be attached to the firearm by attaching the cord to a loop that is attached to a rail secured to the firearm. Related firearm training apparatus are also disclosed.

7 Claims, 7 Drawing Sheets

(56) References Cited

U.S. PATENT DOCUMENTS

| | | | | |
|---|---|---|---|---|
| 8,596,504 | B2 | 12/2013 | Haley et al. | |
| 8,640,373 | B2 | 2/2014 | Burt | |
| 8,793,916 | B2 | 8/2014 | Rogers et al. | |
| D717,391 | S | 11/2014 | Pittman | |
| 9,052,157 | B1 | 6/2015 | Montes | |
| 9,146,074 | B1 | 9/2015 | McCarthy | |
| D753,257 | S | 4/2016 | Azhocar | |
| D753,783 | S | 4/2016 | Pittman | |
| 9,328,992 | B1 * | 5/2016 | Smith | F41C 33/001 |
| 9,435,595 | B2 | 9/2016 | Azhocar | |
| 9,500,438 | B2 | 11/2016 | Mayberry et al. | |
| 9,841,253 | B2 | 12/2017 | Anthony | |
| 9,897,412 | B1 | 2/2018 | Cicero, Jr. | |
| 9,915,499 | B2 | 3/2018 | Alford | |
| 10,077,869 | B2 * | 9/2018 | Semple | F16M 13/04 |
| 10,228,216 | B2 | 3/2019 | Reeves | |
| 10,281,234 | B1 | 5/2019 | Burnsed, Jr. | |
| 10,317,168 | B2 | 6/2019 | Turnbull | |
| 10,466,011 | B2 | 11/2019 | Swan et al. | |
| 10,731,945 | B2 | 8/2020 | Tower | |
| 10,982,930 | B2 | 4/2021 | Lance et al. | |
| 11,073,358 | B2 | 7/2021 | Chin | |
| 11,536,535 | B2 | 12/2022 | Mayberry et al. | |
| 11,609,064 | B2 | 3/2023 | Desomma et al. | |
| 2002/0020725 | A1 | 2/2002 | Verdugo et al. | |
| 2002/0153393 | A1 | 10/2002 | Verdugo et al. | |
| 2005/0034347 | A1 | 2/2005 | Verdugo | |
| 2006/0137233 | A1 * | 6/2006 | Meeks | F41C 33/001 42/94 |
| 2009/0064560 | A1 * | 3/2009 | Saunders, III | F41C 33/001 42/94 |
| 2011/0098161 | A1 * | 4/2011 | Balaker | A63B 21/156 482/131 |
| 2014/0256518 | A1 * | 9/2014 | Seitzer | F41C 27/00 434/21 |
| 2018/0120053 | A1 | 5/2018 | Kolb et al. | |
| 2018/0202762 | A1 | 7/2018 | Alford | |
| 2020/0263951 | A1 | 8/2020 | Bergman | |
| 2021/0048266 | A1 * | 2/2021 | Lewis | F41A 33/00 |
| 2021/0341253 | A1 | 11/2021 | McPhee | |

* cited by examiner

FIREARM TRAINING APPARATUS AND RELATED METHODS OF USE

CROSS-REFERENCE TO RELATED APPLICATIONS

This application hereby incorporates by reference in the entirety herein U.S. patent application Ser. No. 17/716,809 entitled "ATTACHMENT APPARATUS FOR A FIREARM AND RELATED METHODS OF USE" by Michael R. Mansfield as inventor and applicant and filed on 8 Apr. 2022.

BACKGROUND OF THE INVENTION

Field

The present invention relates to firearms, and, more specifically, to a firearm training apparatus.

Background

Firearm training requires practice in order to become proficient and to maintain proficiency, and practice may consume quantities of ammunition. Furthermore, firearm training may require access to a range, and firearm training takes time. Thus, firearm training of police and military personnel is expensive and time consuming, as is firearm training of civilians. Accordingly, there is a need for improved apparatus as well as related methods for firearm training.

BRIEF SUMMARY OF THE INVENTION

These and other needs and disadvantages may be overcome by the method of firearm training and related apparatus disclosed herein. Additional improvements and advantages may be recognized by those of ordinary skill in the art upon study of the present disclosure.

The method of firearm training disclosed herein includes the step of attaching a cord to a firearm and the step of attaching the cord to a frame, in various aspects. The frame may include a vertical member oriented vertically and a second vertical member oriented vertically generally parallel to the vertical member and in spaced relation with the vertical member. The frame has several attachment points disposed upon the vertical member and the second vertical member, and the cord may be engaged with an attachment point selected from the several attachment points. The method of firearm training includes the step of tensioning the cord while aiming the firearm thereby applying a force to the firearm. In various aspects, the cord may be attached to the firearm by attaching the cord to an eyebolt attached to a rail secured to the firearm. The eyebolt may be formed as two or more loops with each loop defining an aperture, and the cord may be attached to an aperture defined by a loop of the two or more loops. The loop(s) are fixed in relation to the firearm, in various aspects.

The firearm training apparatus includes the frame with several attachment points disposed thereupon and the cord, which is attachable to one of the attachment points and to the firearm, in various aspects. The firearm training apparatus may include the eyebolt, which is attachable to a rail secured to the firearm, and the cord may be attached to the eyebolt using an aperture defied by a loop of the eyebolt. Thus, the firearms training apparatus includes several attachment means for attachment of the cord, the several attachment means being disposed about a frame means, in various aspects. The firearms training apparatus includes a loop means for attachment of the cord to a firearm, the loop means being attached to the firearm, in various aspects.

This summary is presented to provide a basic understanding of some aspects of the methods and apparatus disclosed herein as a prelude to the detailed description that follows below. Accordingly, this summary is not intended to identify key elements of the apparatus and methods disclosed herein or to delineate the scope thereof.

Figure 1:
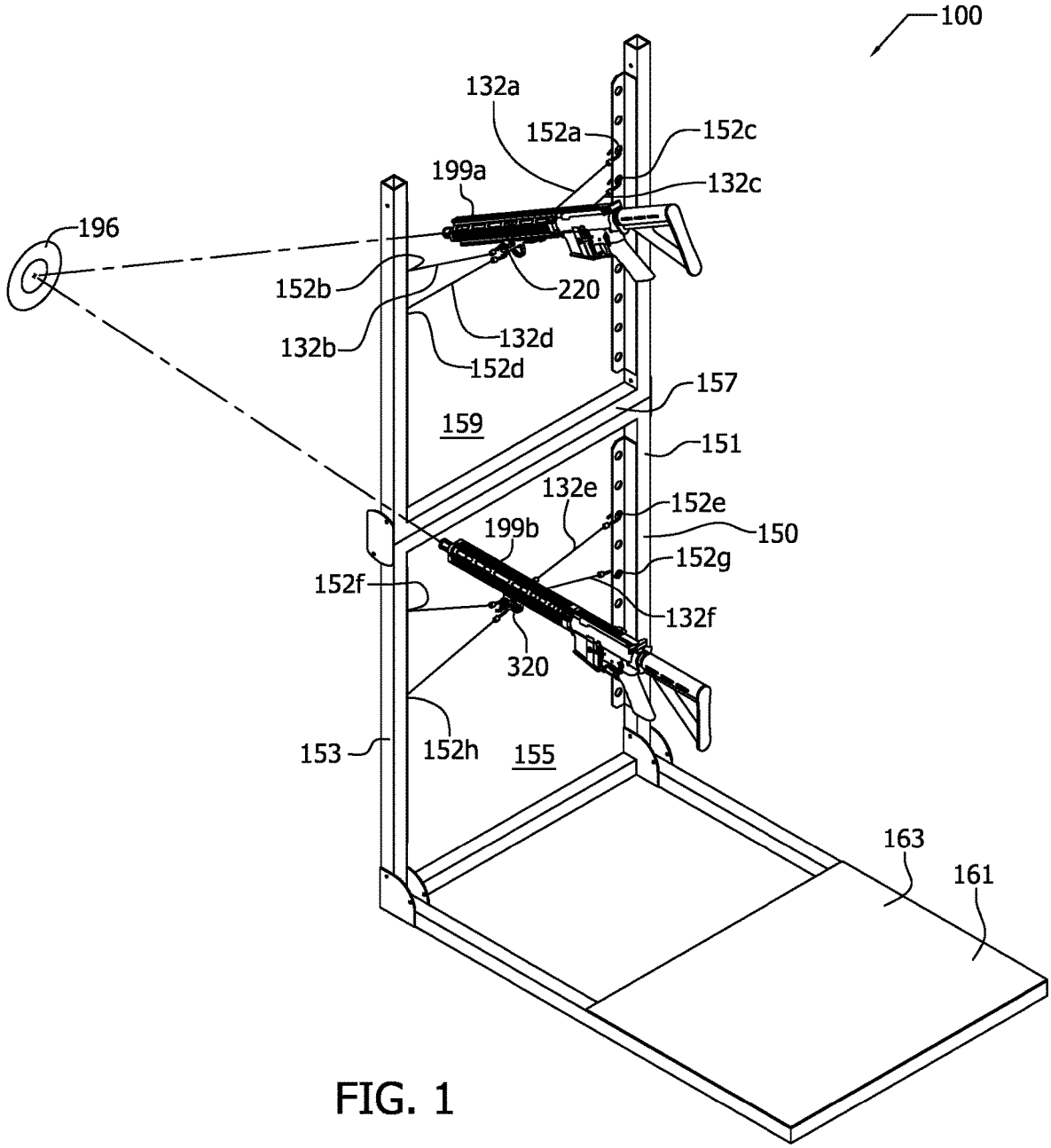
FIG. 1 illustrates by perspective view an exemplary implementation of a firearm training apparatus according to aspects of the present inventions.

The Figures are exemplary only, and the implementations illustrated therein are selected to facilitate explanation. The number, position, relationship and dimensions of the elements shown in the Figures to form the various implementations described herein, as well as dimensions and dimensional proportions to conform to specific force, weight, strength, flow and similar requirements are explained herein or are understandable to a person of ordinary skill in the art upon study of this disclosure. Where used in the various Figures, the same numerals designate the same or similar elements. Furthermore, when the terms "top," "bottom," "right," "left," "forward," "rear," "first," "second," "inside," "outside," and similar terms are used, the terms should be understood in reference to the orientation of the implementations shown in the drawings and are utilized to facilitate description thereof. Use herein of relative terms such as generally, about, approximately, essentially, may be indicative of engineering, manufacturing, or scientific tolerances such as ±0.1%, ±1%, ±2.5%, ±5%, or other such tolerances, as would be recognized by those of ordinary skill in the art upon study of this disclosure.

DETAILED DESCRIPTION OF THE INVENTION

FIG. 1 illustrates exemplary firearm training apparatus 100 with eyebolt 220 (see FIGS. 3A-3D) attached to firearm 199*a* and eyebolt 320 (see FIG. 4) attached to firearm 199*b*. Firearms 199*a*, 199*b* are illustrated in FIG. 1 as carbines for explanatory purposes, but it should be recognized that firearms 199*a*, 199*b* may be variously configured as, for example, rifle(s), pistol(s), shotgun(s), pellet gun(s), crossbow(s), and grenade launcher(s).

As illustrated in FIG. 1, firearm training apparatus 100 includes frame 150. Frame 150 includes vertical member 151 disposed apart from and parallel to vertical member 153 with vertical members 151, 153 extending vertically from base 161, as illustrated. Base 161 supports vertical members 151, 153, which are attached to base 161, and base 161 may be placed, for example, upon a floor, the ground, etc., in this implementation. Base 161, as illustrated, includes platform 163 upon which the user may stand, kneel, lie, and so forth. Cross member 157 extends horizontally between vertical members 151, 153 so that cross member 157 along with portions of vertical members 151, 153 and base 161 define opening 155 that is rectangular and enclosed around a perimeter, as illustrated. Cross member 157 along with other portions of vertical members 151, 153 define opening 159 that is unbounded at portions of a perimeter of opening 159 at an upper end, as illustrated.

Attachment points, such as attachment points 152*a*, 152*b*, 152*c*, 152*d*, 152*e*, 152*f*, 152*g*, 152*h*, are disposed along vertical members 151, 153, as illustrated. The attachment points are illustrated as holes disposed in vertical members 151, 153 configured to receive connectors, such as connectors 133*a*, 133*b*, 133*c*, 133*d* (see FIG. 3C), of cords, such as cord 132*a*, 132*b*, 132*c*, 132*d*, 132*e*, 132*f*. In other implementations, attachment points, such as attachment points 152*a*, 152*b*, 152*c*, 152*d*, 152*e*, 152*f*, 152*g*, 152*h*, may be configured as hooks, U-bolts, and so forth to which cords may be attached. While attachment points, such as attachment points 152*a*, 152*b*, 152*c*, 152*d*, 152*e*, 152*f*, 152*g*, 152*h*, are illustrated as disposed on vertical members 151, 153 for explanatory purposes, it should be recognized that any number of attachment points may be variously provided about frame 150 including cross member 157 and base 161, in various implementations.

As illustrated in FIG. 1, firearm 199*a* is engaged with vertical member 151 of frame 150 by attachment of cord 132*a* to eyebolt 220 and to attachment point 152*a* and by attachment of cord 132*c* to eyebolt 220 and to attachment point 152*c*. Firearm 199*a* is engaged with vertical member 153 of frame 150 by attachment of cord 132*b* to eyebolt 220 and to attachment point 152*b* and by attachment of cord 132*d* to eyebolt 220 and to attachment point 152*d*, as illustrated in FIG. 1. Firearm 199*a* is generally positioned about opening 159, as illustrated in FIG. 1, and a user may, for example, stand upon platform 163 while using firearm 199*a*.

Similarly, as illustrated in FIG. 1, firearm 199*b* is engaged with vertical members 151, 153 of frame 150 by attachment of cord 132*e* to eyebolt 320 (see FIG. 4) and to attachment points 152*e*, 152*f*, respectively, and by attachment of cord 132*f* to eyebolt 320 and to attachment points 152*g*, 152*h*, respectively. Cords 132*e*, 132*f* may pass through first aperture 322 and through second aperture 324, respectively, of eyebolt 320, so that eyebolt 320 is slidably received by cords 132*e*, 132*f*, in this exemplary implementation. Firearm 199*b* is generally positioned about opening 155, as illustrated in FIG. 1, and a user may, for example, kneel, sit, or lie upon platform 163 while using firearm 199*b*.

Target 196 is illustrated in FIG. 1 as a single "bullseye" for explanatory purposes. It should be recognized that target 196 may assume various configurations such as a silhouette, 3-dimensional shape, grid, and so forth, as would be readily recognized by those of ordinary skill in the art upon study of this disclosure. Also, it should be recognized that multiple targets, such as target 196, may be provided in various implementations.

Figures 2A, 2B:
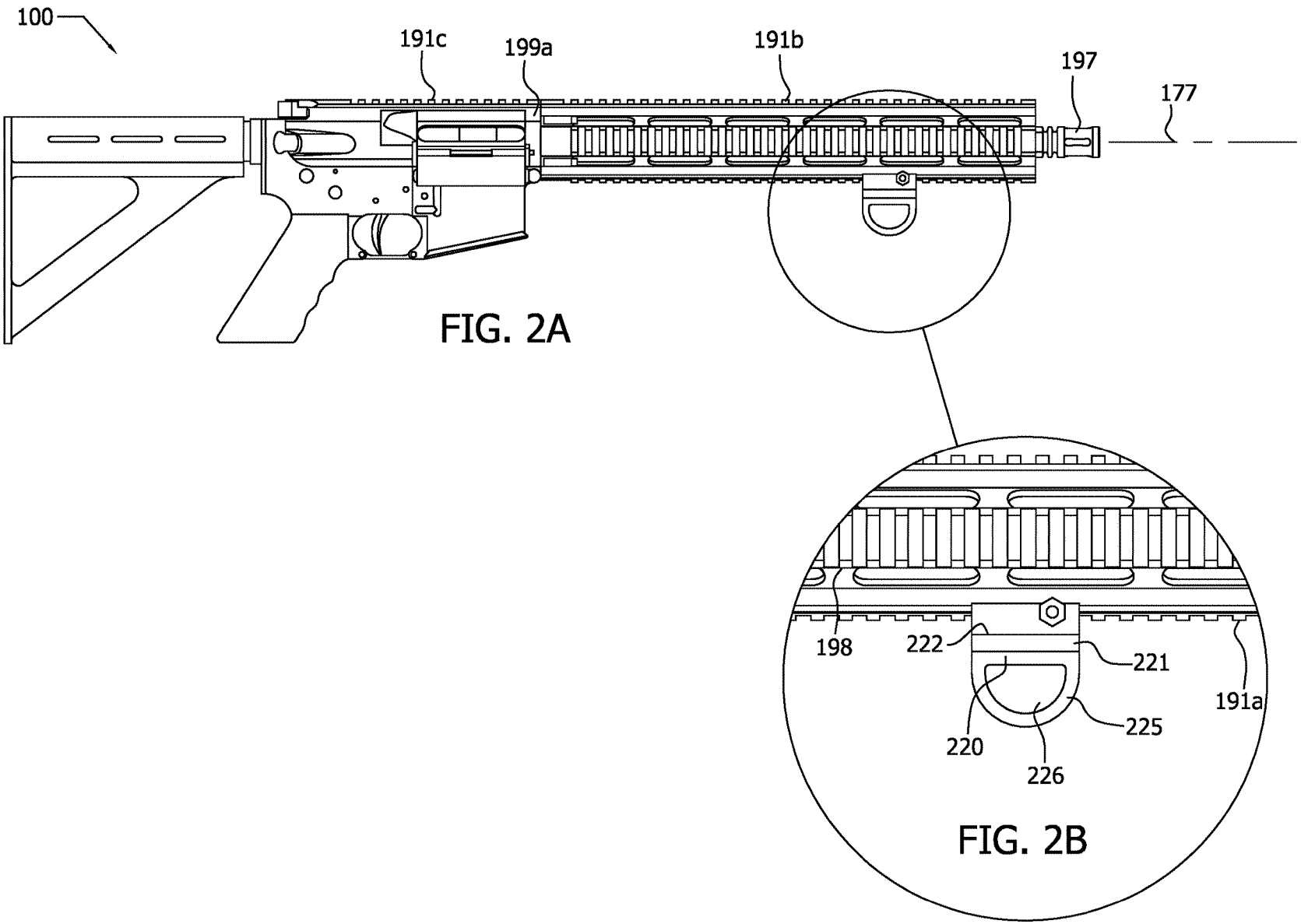
FIG. 2A illustrates by side view portions of the exemplary implementation of a firearm training apparatus of FIG. 1.
FIG. 2B illustrates by an expanded side view portions of FIG. 2A.

FIGS. 2A, 2B illustrate eyebolt 220 attached to firearm 199*a* by compressive biasment of portions of eyebolt 220 against portions of a rail, such as rail 191*a*, 191*b*, 191*c*. As illustrated in FIG. 2A, firearm 199*a* includes rails 191*a*, 191*b*, 191*c*, and eyebolt 220 is attached to rail 191*a* disposed on an underside of receiver 198. Eyebolt 220 may be attached to any one of rails 191*a*, 191*b*, 191*c*, in various implementations. One or more rail(s), such as rails 191*a*, 191*b*, 191*c* may be secured to firearm 199*a* in various dispositions about firearm 199*a*, as would be readily recognized by those of ordinary skill in the art upon study of this disclosure, and one or more eyebolts, such as eyebolt 220, may be attached to the rail(s) disposed about firearm 199*a*, in various implementations. Rails 191*a*, 191*b*, 191*c* are illustrated as Picatinny rails that conform to U.S. military standard MIL-STD-1913 for purposes of explanation. It should be understood that rails, such as rails 191*a*, 191*b*, 191*c*, disclosed herein may be formed according to Weaver, M-LOK, KeyMod, NATO conforming to STANAG 4694, and other standards and combinations thereof, as would be readily recognized by those of ordinary skill in the art upon study of this disclosure.

Figure 3A:
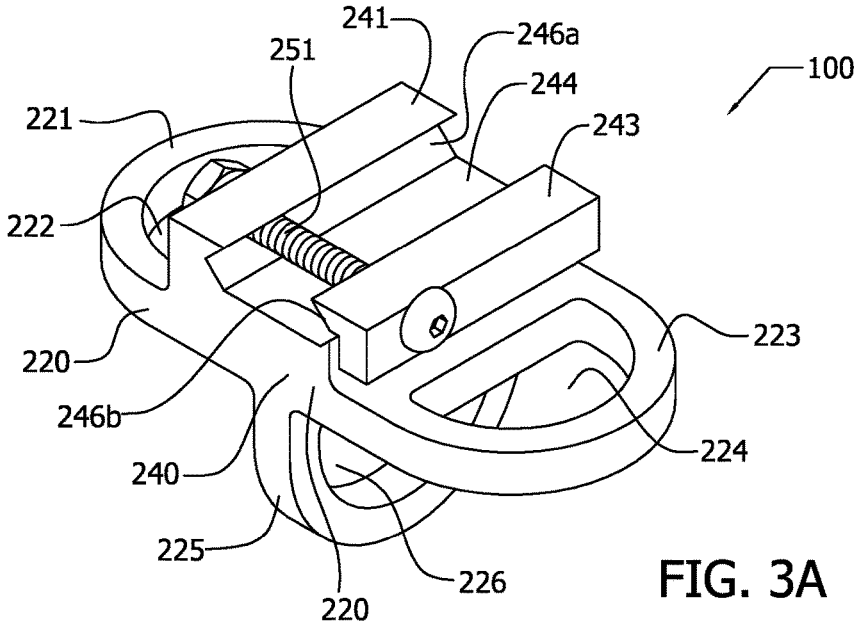
FIG. 3A illustrates by perspective view an exemplary implementation of an eyebolt that forms a portion of the firearm training apparatus of FIG. 1.
Figure 3B:
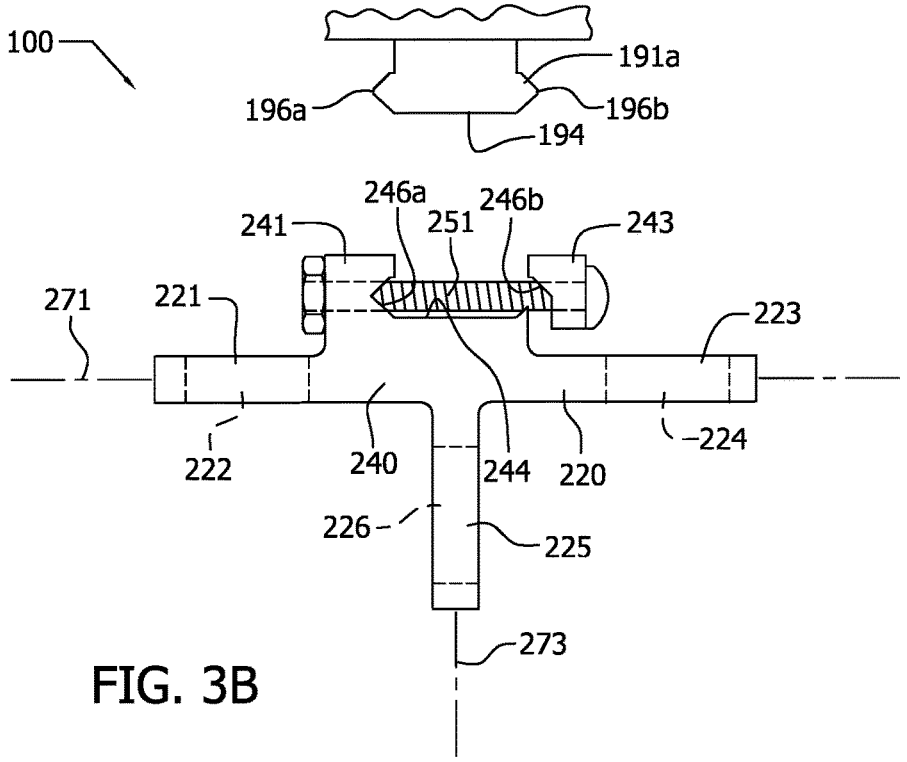
FIG. 3B illustrates by frontal view the eyebolt of FIG. 3.
Figure 3C:
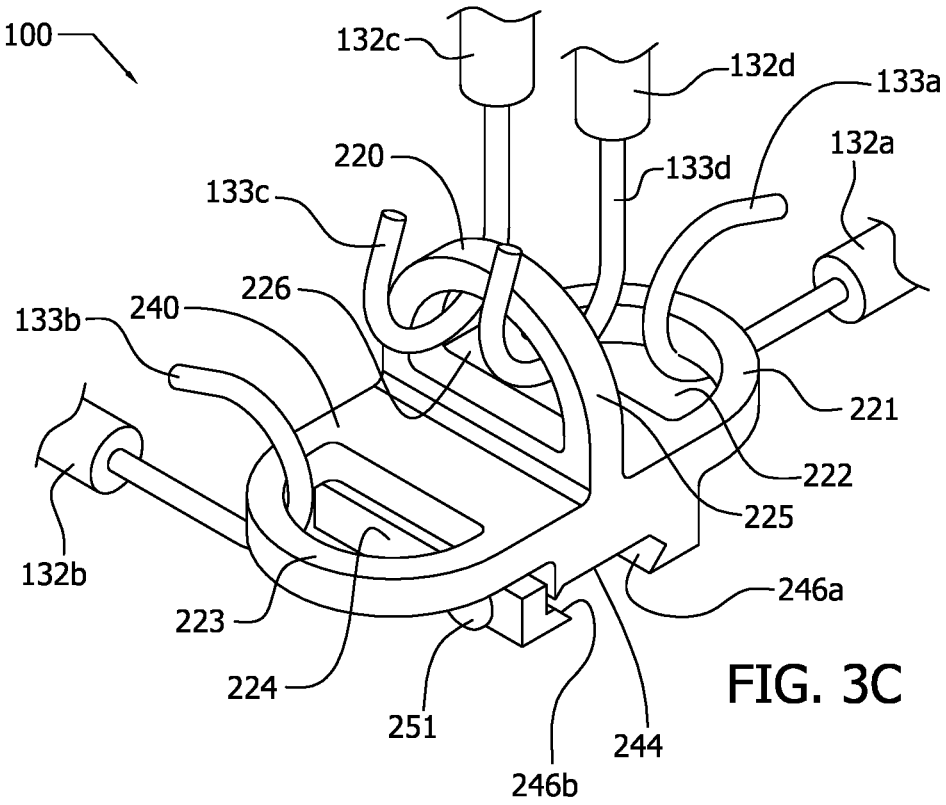
FIG. 3C illustrates by bottom perspective the of FIG. 3.

FIGS. 3A, 3B, 3C, 3D further illustrate eyebolt 220. As illustrated in FIGS. 3A, 3C, eyebolt 220 includes first loop 221, second loop 223, and third loop 225 that define corresponding first aperture 222, second aperture 224, and third aperture 226, respectively, so that each loop defines a corresponding aperture. First loop 221, second loop 223, and third loop 225 are in secured disposition about fixture portion 240 of eyebolt 220, as illustrated, and fixture portion 240 is attachable removably to a rail, such as rail 191*a*, 191*b*, 191*c*. For example, eyebolt 220 may be formed of steel, aluminum, or rigid high strength plastic, and may be machined or cast. As illustrated, eyebolt 220 is of rigid unitary construction with first loop 221, second loop 223, third loop 225, and fixture portion 240 being in fixed relation with one another. Thus, first loop 221, second loop 223, and third loop 225 are immobile in fixed relation with respect to rail 191*a* to which fixture portion 240 is attached, and, therefore, first loop 221, second loop 223, and third loop 225 are immobile in fixed relation with firearm 199*a*.

As illustrated in FIG. 3B, first loop 221 and second loop 223 lie in plane 271 that is parallel to axis 177 (see FIG. 2A) of barrel 197. First aperture 222 and second aperture 224 of first loop 221 and second loop 223, respectively, pass perpendicularly through plane 271. Third loop 225 lies in perpendicular plane 273 that is perpendicular to plane 271 and radial to axis 177 with axis 177 generally lying within perpendicular plane 273, as illustrated in FIG. 3B. Third aperture 226 of third loop 225 passes perpendicularly through perpendicular plane 273, as illustrated. Thus, for example, when firearm 199*a* is being sighted generally horizontally at target 196 by the user, plane 271 may be oriented generally horizontally and perpendicular plane 273 may be oriented generally vertically, so that first loop 221 and second loop 223 extend outward from sides of receiver 198 and third loop 225 extends downward from receiver 198.

As illustrated in FIGS. 3A, 3B, fixture 240 defines clamp member 241 with surface 246*a* and fixture 240 defines surface 244. Opposing clamp member 243 is positionably engaged with fixture 240 by fastener 251, as illustrated, and opposing clamp member 243 defines, at least in part, surface 246*b*, and a remaining portion of surface 246*b*, if any, may be defined by fixture 240. Surface 244, which is generally planar, is sized to conform to surface 194 of rail 191*a* in order to allow surface 244 to engage biasingly surface 194, in this implementation. Surfaces 246*a*, 246*b* are sized and shaped to conform to surfaces 196*a*, 196*b* of rail 191*a*, respectively, as illustrated in FIG. 3B, in order to allow surfaces 246*a*, 246*b* to engage biasingly surfaces 196*a*, 196*b*, respectively.

With surface 244 of fixture 240 biased against surface 194, fastener 251 may be tightened in order to bring surfaces 246*a*, 246*b* into biased engagement with surfaces 196*a*, 196*b*, respectively thereby attaching fixedly eyebolt 220 to rail 191*a*, in this implementation. Fastener 251 may be loosened in order to bring surfaces 246*a*, 246*b* out of biased engagement with surfaces 196*a*, 196*b*, respectively, thereby allowing eyebolt 20 to be slidably positioned along rail 191*a* or allowing eyebolt 220 to be removed entirely from rail 191*a*.

Figure 3D:
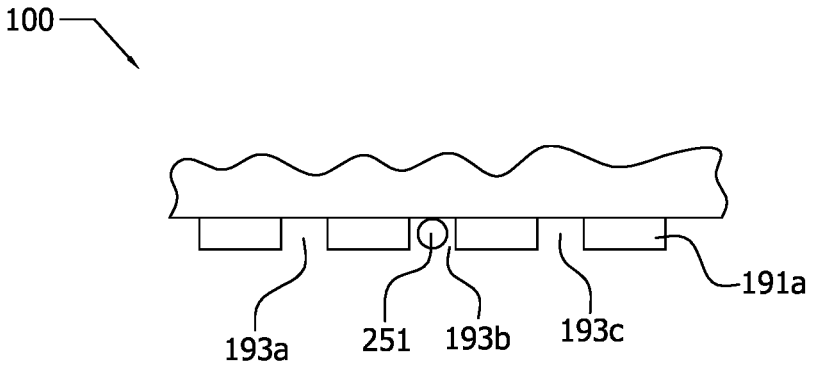
FIG. 3D illustrates by side view portions of the firearm training apparatus of FIG. 1 including portions of the eyebolt of FIG. 3.

Rail 191*a*, as illustrated in FIG. 3D, includes recoil grooves 193*a*, 193*b*, 193*c*. A portion of fastener 251 between clamp member 241 and opposing clamp member 243 is illustrated in FIG. 3D as engaged with rail 191*a* within recoil groove 293*b* to secure eyebolt 220 with rail 191*a* against sliding along rail 191*a*. Note that portions of eyebolt 220 other than fastener 251 are omitted from FIG. 3D for clarity of explanation.

Fastener 251 is illustrated as threaded for threaded engagement, for example, with clamp member 241 or with a hexagonal nut (as illustrated) or wingnut. Fastener 251 may have a head with a mortise configured to receive an Allen key (as illustrated), a hex head, a grippable head, or a head configured to receive a Torx bit, Phillips bit, or so forth, to allow a user to tighten or loosen the engagement of clamp member 241 and opposing clamp member 243 with rail 191*a* by tightening or loosening fastener 251, respectively. Fastener 251 may be configured in other ways to allow the user to tighten or loosen the engagement of clamp member 241 and opposing clamp member 243 with rail 191*a*, in various other implementations, as would be readily recognized by those of ordinary skill in the art upon study of this disclosure. Although only a single fastener 251 is included in this illustrated implementation, it should be recognized that other implementations may include two or more fasteners, such as fastener 251, and that each of the two or more fasteners may uniquely engage a recoil groove, such as recoil groove 193*a*, 193*b*, 193*c*.

As illustrated in FIG. 3C, cord 132*a* is engaged with first loop 221 through first aperture 222 by connector 133*a*, cord 132*b* is engaged with second loop 223 through second aperture 224 by connector 133*b*, and cords 132*c*, 132*d* are engaged with third loop 225 through third aperture 226 by connectors 133*c*, 133*d*, respectively. A cord, such as cord 132*a*, 132*b*, 132*c*, 132*d*, 132*e*, 132*f*, may be formed, for example, as a bungee cord (e.g., elastic strands in a fabric casing with hooks as connectors at the ends), rubber strip(s), spring(s), or other elastic cord or rope configured to be tensioned to provide resistance to the firearm. The cord may have connectors, such as connectors 133*a*, 133*b*, 133*c* 133*d*, integrally formed at the ends. In other implementations, the cord may be may be generally inelastic such as a cable, rope, or chain, while being configured to provide resistance to the firearm, such as in exemplary firearm training apparatus 400 illustrated in FIG. 5. Connectors 133*a*, 133*b*, 133*c* 133*d* are illustrated as hooks in FIG. 3C for purposes of explanation. In other implementations, connectors 133*a*, 133*b*, 133*c* 133*d* may be configured as, for example, clips or carabiners that releasably attach to first loop 221, second loop 223, third loop 225 and may be variously secured to the cord. More or fewer cords than illustrated in FIG. 3C may be used in various implementations, and the cord(s) may be various engaged with the loop(s). Certain loops may not be engaged by a cord, in some implementations. First aperture 222, second aperture 224, and third aperture 226 may be sized to allow a connector portion of the cord to pass therethrough.

Figure 4:
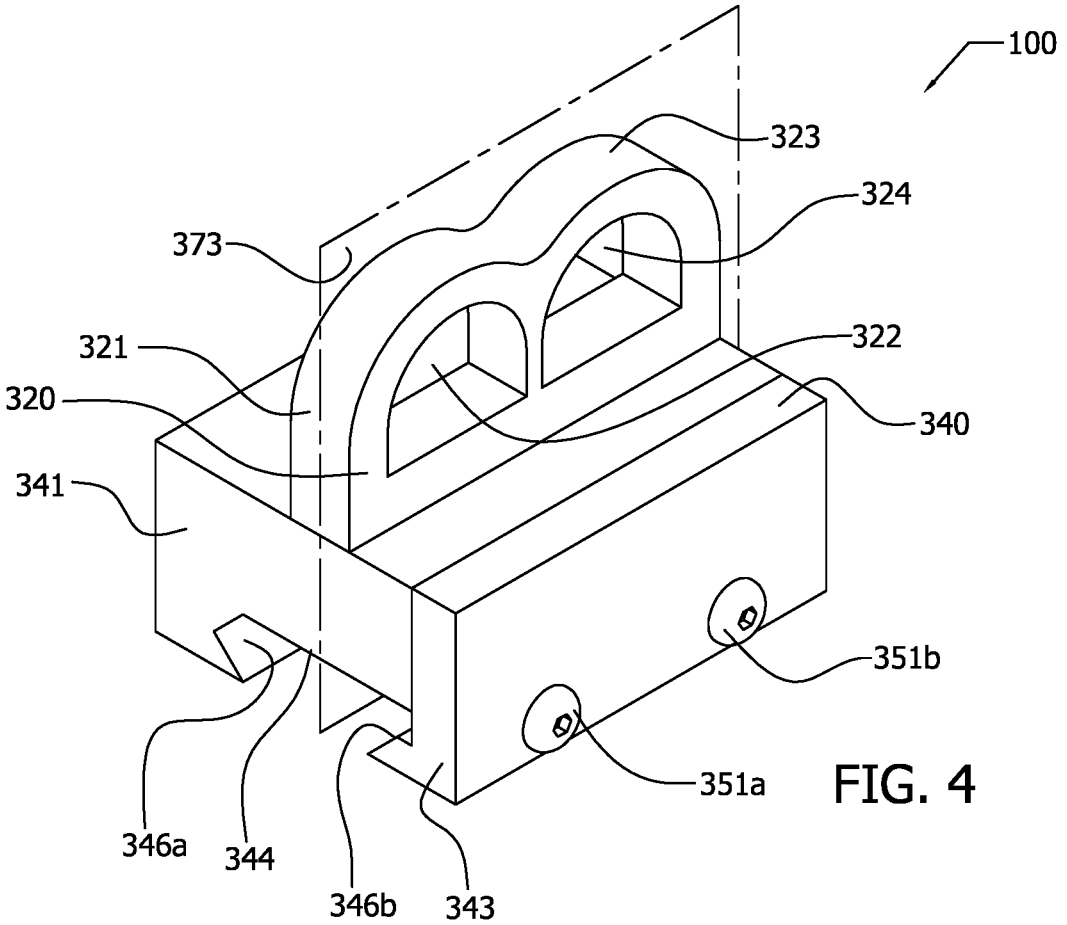
FIG. 4 illustrates by perspective view a second exemplary implementation of an eyebolt as may form a portion of the firearm training apparatus of FIG. 1.

FIG. 4 illustrates eyebolt 320. As illustrated in FIG. 4, eyebolt 320 includes first loop 321 and second loop 323 secured to fixture 340, with first loop 321 defining first aperture 322 and second loop 323 defining second aperture 324. As illustrated in FIG. 4, first loop 321 and second loop 323 are disposed axially with respect to one another generally along an axis of a barrel of a firearm, such as axis 177 of barrel 197 of firearm 199*a*. Thus, in this implementation, first loop 321 and second loop 323 lie in perpendicular plane 373 that is radial to the axis of the firearm, and first aperture 322 and second aperture 324 pass through perpendicular plane 373, as illustrated in FIG. 4. For example, when the firearm 199*b* to which eyebolt 320 is attached is being sighted generally horizontally at target 196 by the user, perpendicular plane 373 may be oriented generally vertically, so that first loop 321 and second loop 323 extend from a receiver, such as receiver 198*a*, with first loop 321 forward of second loop 323 toward a muzzle of the barrel of the firearm, and second loop 323 rearward of first loop 321 toward a butt of the firearm. Per this example, first aperture 322 and second aperture 324 pass generally horizontally through perpendicular plane 373.

As illustrated in FIG. 4, fixture 340 defines clamp member 341 with surface 346*a* and surface 344. Opposing clamp member 343 is positionably engaged with fixture 340 by fasteners 151*a*, 151*b*, as illustrated. Opposing clamp member 343 defines surface 346*b*, in this implementation. With surface 344 of fixture 340 biased against a surface, such as surface 194, of a rail, such as rail 191*a*, 191*b*, 191*c*, fasteners 351*a*, 351*b* may be tightened thereby bringing surfaces 346*a*, 346*b* into biased engagement with surfaces of the rail, such as surfaces 196*a*, 196*b*, respectively, thereby attaching fixedly eyebolt 320 to the rail, in this implementation. In this implementation, fasteners 351*a*, 351*b* engage recoil grooves, such as recoil grooves 193*a*, 193*b*, 193*c*, of the rail, with fastener 351*a* engaging a recoil groove different from a recoil groove engaged by fastener 351*b*.

Figure 5:
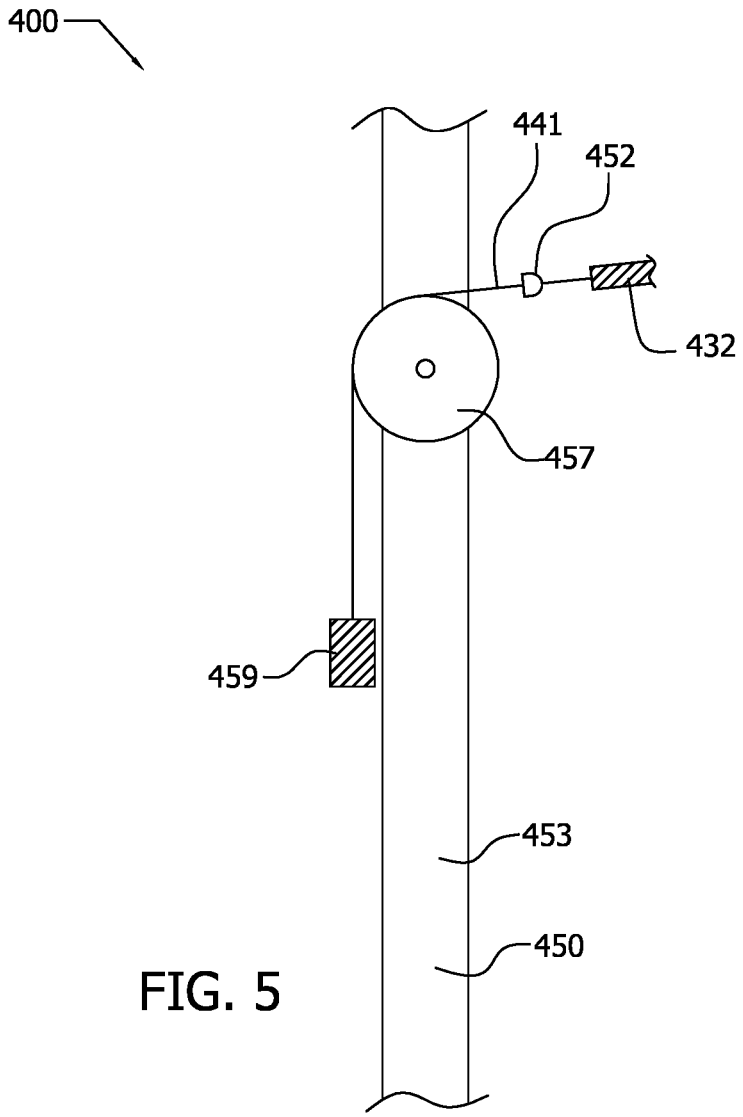
FIG. 5 illustrates by elevation view portions of another exemplary implementation of a firearm training apparatus according to aspects of the present inventions; and, FIG. 6 illustrates by process flow chart an exemplary method of use of the exemplary implementations of a firearm training apparatus of FIG. 1 and FIG. 4.

FIG. 5 illustrates portions of exemplary firearm training apparatus 400 including portions of vertical member 453 of frame 450. As illustrated in FIG. 5, attachment point 452 is formed as a D-ring attached to cable 441 that, in turn, is connected to weight 459. Cable 441 cooperates with pulley 457 attached rotatably to vertical member 453 to allow weight 459 to apply force through cable 441 to attachment point 452, and, thence, to cord 432 attached to attachment point 452. Cord 432 may then be attached to an eyebolt, such as eyebolt 220, 320 that, in turn, is attached to a firearm, such as firearm 199*a*, 199*b*. Cord 432 may be elastic, in some implementations, or cord 432 may be a cord, cable, rope, chain, or otherwise be generally inelastic, in other implementations.

Figure 6:
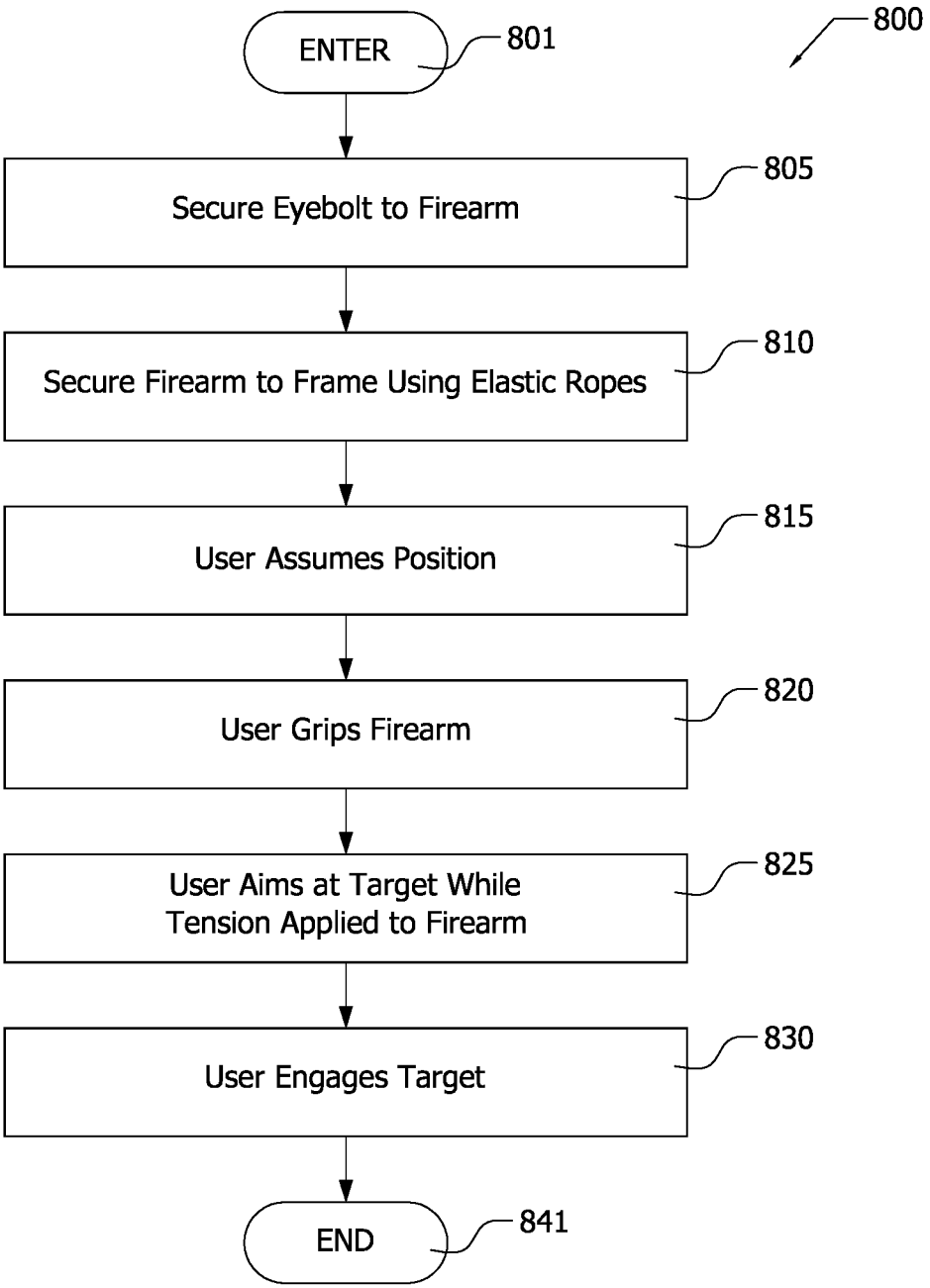

An exemplary usage of a firearm training apparatus, such as firearm training apparatus 100, 400, is presented in method 800 illustrated in FIG. 6. Exemplary method 800 is entered at step 801. At step 805, an eyebolt, such as eyebolt 220, 320, is attached to a firearm, such as firearm 199*a*, 199*b*, by attachment to a rail, such as rail 191*a*, 191*b*, 191*c*, disposed about the firearm. The eyebolt provides a loop means for attachment of the cord to a firearm, in various implementations.

At step 810, one or more cords, such as cord 132*a*, 132*b*, 132*c*, 132*d*, 132*e*, 132*f*, 432, are attached to the eyebolt and to attachment point(s), such as such as attachment point 152*a*, 152*b*, 152*c*, 152*d*, 152*e*, 152*f*, 152*g*, 152*h*, 452, disposed about a frame, such as frame 250, 450, of the firearm training apparatus. The several attachment points provide several attachment means for attachment of a cord, and the several attachment means are disposed about a frame means, in various implementations.

At step 815, a user assumes a shooting position about the frame such as, for example, a standing position, a sitting position, or a prone position, and the user may be at least in part disposed upon a base, such as base 161, of the firearm training apparatus while in the shooting position.

At step 820, the user grips the firearm.

At step 825, the user aims the firearm toward a target, such as target 196. While aiming the firearm toward the target, the one or more cords are tensioned thereby applying a tension force upon the firearm. The one or more cords may be tensioned by elastic stretching of the one or more cords, by weight(s) applied to the one or more cords, or combinations thereof. The user holds the firearm aimed toward the target while holding the firearm against the tension force applied to the firearm by the cord at exemplary step 825.

In some implementations, the one or more cords are tensioned elastically by being stretched thereby applying a force to the firearm as the user aims the firearm. The user may variously position the firearm to stretch the one or more cords. The user may alter the position of the firearm in order to vary the force applied to the firearm by the one or more cords. In such implementations, the force applied to the firearm varies depending upon the amount of stretching of the cord(s).

In other implementations, one or more cords may be tensioned by gravity using a weight, such as weight 459. The force applied to the firearm is constant and depends upon the weight, in such implementations. The one or more cords, in such implementations, may be essentially inelastic.

At step 830, the user engages the target while the force is being applied to the firearm. The user may engage the target, for example, by firing live ammunition at the target, by dry firing, or by laser simulation, in various implementations.

Method 800 terminates at step 841.

Training by aiming the firearm toward the target while holding the firearm against force as described by exemplary method 800 using may enhance the user's ability to hold a steady aim and may otherwise enhance the user's facility with the firearm. Method 800 may enhance the user's facility with the firearm by functional strength training, improvement of motor coordination and balance, movement sequencing, and visualization.

Functional strength training focuses on compound movements of the user involving more than one muscle group at the same time. One of the primary goals of functional strength training may be to offer resistance. In exemplary method 800, muscles work against the tension applied to the firearm while the firearm is being aimed at the target. The functional strength training of method 800 may not train just one muscle group at a time, but rather train several muscle groups at once. For example, method 800 trains numerous muscles in all directions not just some muscles downward by weight loading of the gun (e.g., weighted long guns). As a result, strength may be built holistically, forcing the user's body to function as a single unit.

Motor coordination may be defined as the ability to use different parts of the body together smoothly and efficiently. For example, motor coordination occurs when two or more body parts are used at the same time to complete a task. Motor coordination may be generally be broken down into three separate skills:

Fine motor skills: the coordinated movement of small muscles, like in the hands when pulling a trigger while not causing the gun to move.

Gross motor skills: the coordinated movement of large muscles, like the legs or arms, including aiming at several targets in sequence at various extremes of position.

Hand-eye skills: the ability of the eyes to coordinate visual information and direct the hands to perform a task, like putting the sights in alignment with a target.

Method 800 may implicate fine motor skills, gross motor skill, and hand-eye skills. For example, the muscles of the abdomen, the legs, the arms, the gripping forearm muscles and the fingers are challenged while aiming the firearm while force is being applied to the firearm.

Good balance may be the foundation for good coordination. Balance may be defined, in part, as the ability to control the body in space while performing static movements. Good balance may be the cornerstone of performing the most skills including firearm skills. In method 800, the user balances against forces applied to the firearm while in the shooting position, thereby enhancing the user's balance.

By moving the firearm against resistance, method 800 may enhance the user's self-awareness by allowing cognition of what the user's body is actually doing. Method 800 may enhance sequencing. Sequencing is the understanding of how one part of the movement chain will affect subsequent movement. For example, understating the movement of the firearm from a ready position to aiming at a target. Method 800 may enhance visualization—mentally picturing the performing of firearm usage. Method 800 may incorporate a laser attached to the firearm in order to add visual stimulation.

The foregoing discussion along with the Figures discloses and describes various exemplary implementations. These implementations are not meant to limit the scope of coverage, but, instead, to assist in understanding the context of the language used in this specification and in the claims. The Abstract is presented to meet requirements of 37 C.F.R. § 1.72(b) only. Accordingly, the Abstract is not intended to identify key elements of the apparatus and methods disclosed herein or to delineate the scope thereof. Upon study of this disclosure and the exemplary implementations herein, one of ordinary skill in the art may readily recognize that various changes, modifications and variations can be made thereto without departing from the spirit and scope of the inventions as defined in the following claims.

The invention claimed is:

1. A method of firearm training, comprising the steps of:

attaching at least one cord to a firearm;

attaching the firearm to a frame using the at least one cord, the frame comprising a vertical member oriented vertically and a second vertical member oriented vertically generally parallel to the vertical member in spaced relation with the vertical member, the frame having several attachment points separably fixedly disposed upon the vertical member and the second vertical member, the at least one cord being attached to two or more separate attachment points of the several attachment points;

tensioning the at least one cord while aiming the firearm; and attaching a cord to a firearm by attaching the cord to an eyebolt attached to a rail secured to the firearm, the eyebolt comprising at least three loops with each loop defining an aperture, the cord being attached to an aperture defined by a loop of the at least three loops.

2. The method of claim 1, wherein the cord is tensioned elastically by being stretched while aiming the firearm.

3. A firearm training apparatus, comprising:

a frame comprising a vertical member oriented vertically and a second vertical member oriented vertically generally parallel to the vertical member in spaced relation with the vertical member;

several attachment points separably fixedly disposed about the vertical member and the second vertical member;

a firearm attached to two or more separate attachment points of the several attachment points by at least one cord, the at least one cord is comprised of an elastic material; and an eyebolt attachable to a rail secured to the firearm, the eyebolt comprising a first loop formed as a fixed portion of the eyebolt, the first loop defining a first aperture, and a second loop formed as a fixed portion of the eyebolt, the second loop defining a second aperture, at least one of the first loop and the second loop being adapted for attachment to the cord;

wherein the eyebolt being attached to the firearm, the first loop and the second loop are disposed on opposing sides of a barrel of the firearm, the first loop and the second loop lying in a plane that is parallel to an axis of the barrel of said firearm, and the first aperture and the second aperture passing perpendicularly through the plane; and a third loop defining a third aperture configured, the third loop lying in a perpendicular plane that is perpendicular to the plane of the first loop and the second loop and radial to the axis of the barrel of said firearm.

4. The apparatus of claim 3, wherein the eyebolt being secured to the firearm, the first loop and the second loop are disposed axially with respect to one another generally along an axis of a barrel of said firearm, the first loop and the second loop lie in a perpendicular plane that is radial to the axis.

5. The apparatus of claim 3, further comprising:

a base extending horizontally from the frame to support a user at least in part.

6. The apparatus of claim 3, wherein the frame defines an opening bounded by members around a perimeter of the opening.

7. The apparatus of claim 3, wherein the eyebolt is attached to a rail secured to the firearm, the rail configured as a Picatinny rail that conform to U.S. military standard MIL-STD-1913.

* * * * *